US005299646A

United States Patent [19]

Courtney

[11] Patent Number: 5,299,646

[45] Date of Patent: Apr. 5, 1994

[54] METHOD AND MEANS OF EXTINGUISHING FIRES IN OIL WELLS

[75] Inventor: Leonard O. Courtney, Ottumwa, Iowa

[73] Assignee: Courtney's Fire Crusher, Inc., Ottumwa, Iowa

[21] Appl. No.: 72,870

[22] Filed: Jun. 22, 1993

Related U.S. Application Data

[63] Continuation of Ser. No. 729,646, Jul. 15, 1991, abandoned.

[51] Int. Cl.[5] ..... A62C 3/06

[52] U.S. Cl. ..... 169/52; 169/69

[58] Field of Search ..... 169/43, 47, 49, 52, 169/69

[56] References Cited

U.S. PATENT DOCUMENTS

| | | | |
|---|---|---|---|
| 3,620,299 | 11/1971 | Wiseman, Jr. | 169/69 X |
| 3,685,584 | 8/1972 | Gracia | 169/69 X |
| 5,180,018 | 1/1993 | Taylor | 169/69 X |

FOREIGN PATENT DOCUMENTS

| | | | |
|---|---|---|---|
| 1331427 | 5/1963 | France | 169/69 |
| 1062534 | 3/1967 | United Kingdom | 169/69 |
| 1592972 | 7/1981 | United Kingdom | 169/69 |

*Primary Examiner*—David M. Mitchell
*Assistant Examiner*—Andrew C. Pike
*Attorney, Agent, or Firm*—McAndrews, Held & Malloy Ltd.

[57] ABSTRACT

Fires in oil wells are contained by placing a pipe ring containing selectively located and aimed spray nozzles around a burning oil well by a self-propelled vehicle that includes a controllable boom for raising and lowering the pipe ring and a pump to supply liquid carbon dioxide to the spray nozzles to form a substantially cylindrical or conical volume of liquid carbon dioxide around the oil well. The spray excludes oxygen from the region inside the cylindrical volume and the fire is extinguished by lack of oxygen as it is cooled. Some of the spray may be directed away from the pipe ring to cool heated objects near the fire. In one embodiment of the invention, a ring containing spray nozzles is moved by a walking boom to surround and put out a fire in a well in which the flow rate is relatively high. In another embodiment a fire in a well in which the flow rate is less may be put out by a containment cap containing spray nozzles that is placed over the fire by a boom attached to a vehicle such as an articulated loader to spray the fire.

4 Claims, 3 Drawing Sheets

METHOD AND MEANS OF EXTINGUISHING FIRES IN OIL WELLS

This application is a continuation application of application Ser. No. 07/729,646 filed on Jul. 15, 1991, now abandoned.

BACKGROUND OF THE INVENTION

This invention is related to the extinguishing of fires in oil wells and the like. In particular, it is a method and means of keeping oxygen from the combustion region of an oil well fire and also of cooling that region so that the fire will go out.

A fire in an oil well in which the oil is under pressure from the earth presents a difficult problem. To control the fire it is necessary to extinguish the flames so that the well can be capped to stop the flow of oil. The site of a burning well is typically unreachable by work crews because of the high temperatures associated with the fire. The well-known ways of extinguishing fires include, alone or in combination, preventing oxygen from reaching the combustible materials, cooling the combustible materials below their ignition temperature, and removing the source of combustible materials. The final step of capping the well or installing a device which permits control of the flow will eventually achieve the objective of removing combustible materials from the fire scene. The first objective, therefore, must be to put out the fire so crews can reach the well to control the flow.

The traditional method of fire fighting by spraying a fire with water is of little use in fighting oil fires. While some secondary benefit might be obtained from the cooling effect of the water, the immiscibility of oil and water assures that the water does not wet the oil and therefore that the oil that is being heated by the flames is not appreciably cooled.

Carbon dioxide has long been used as a fire-extinguishing medium. It is non-combustible and is denser than air in its gaseous state, so it tends to blanket an area around a fire when sprayed on the fire. However, delivery of carbon dioxide to a fire by means of a horn or the like tends to be ineffective on a fire in an oil well or other such source of combustible fluid under pressure that flows to feed the fire. Such a fire is best extinguished by some combination of cooling the surroundings of the fire and also excluding oxygen until the fire is out.

While fires in oil wells are of particular present concern, it should be noted that methods and means for putting out fires in oil wells are usually equally as effective in controlling fires in natural gas wells and pipeline leaks.

SUMMARY OF THE INVENTION

It is an object of the present invention to provide a better way of extinguishing fires in oil wells.

It is a further object of the present invention to provide a method of and means for extinguishing fires in oil and natural gas wells by depriving the fires of the oxygen necessary to maintain combustion and by cooling the surroundings.

It is a further object of the present invention to provide an apparatus that can be deployed at a burning oil well to exclude oxygen from the fire and cool the region around the fire.

It is a further object of the present invention to provide an apparatus for extinguishing oil well fires that is self-propelled so as to permit the placement of nozzles to spray a noncombustible gas such as carbon dioxide around the base of the fire.

It is a further object of the present invention to provide a containment cap to be placed by remote control over a burning oil well to starve the fire of oxygen and also cool it by controlled spray of carbon dioxide inside the containment cap.

It is a further object of the present invention to provide a method of extinguishing a fire in an oil well by moving an apparatus to the well and controlling the apparatus remotely to smother and cool the fire with carbon dioxide.

Other objects will become apparent in the course of a detailed description of the invention.

Fires in oil wells are contained by placing A pipe ring containing selectively located and aimed spray nozzles around a burning oil well and spraying a noncombustible substance such as liquid carbon dioxide from the spray nozzles so as to form a substantially cylindrical or conical volume of the noncombustible substance around the oil well. The spray will exclude oxygen from the region inside the cylindrical volume and the fire will be extinguished for lack of oxygen as it is cooled. A portion of the spray may be directed away from the pipe ring to cool heated objects near the fire. The pipe ring and nozzles are placed about a burning oil well by a self-propelled vehicle that includes a controllable boom for raising and lowering the pipe ring. The boom includes or carries a pipe that supplies a noncombustible gas such as carbon dioxide to the ring and thence to the plurality of nozzles disposed about the ring. The self-propelled vehicle preferably includes or is associated with a tank that contains the noncombustible substance that will be sprayed in some convenient form, either under pressure as a gas or liquefied. A pump on the self-propelled vehicle delivers the noncombustible substance in an appropriate form to the ring under pressure where it is thus distributed from the nozzles. The noncombustible substance may also be supplied to the pipe ring under its own storage pressure. In one embodiment of the invention, a ring containing spray nozzles is moved by means of a walking boom to surround and put out a fire in a well in which the flow rate is relatively high. In another embodiment a fire in a well in which the flow rate is less may be put out by a containment cap that is placed over the fire by a boom attached to a vehicle such as an articulated loader. The containment cap includes spray nozzles that deliver liquid carbon dioxide or the like inside the containment cap to cool the fire and its surroundings and to put out the fire by displacing the oxygen it needs to continue burning.

DETAILED DESCRIPTION OF THE INVENTION

Figure 1:
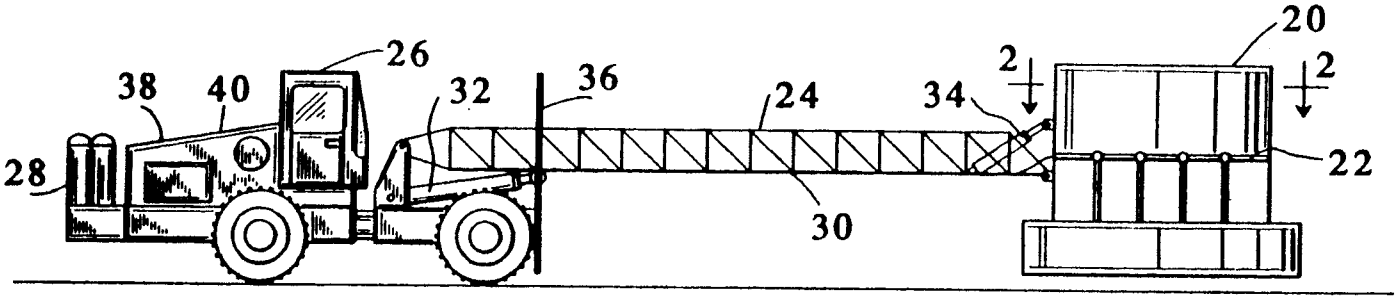
FIG. 1 is a side view of an apparatus for the practice of the present invention that is best adapted for fires in low-pressure oil wells.
Figure 1A:
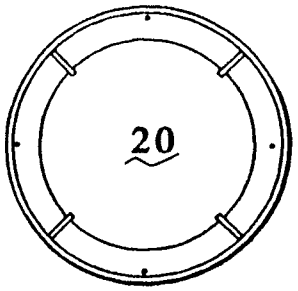
FIG. 1A is a top view of the containment cap 20 of FIG. 1.

FIG. 1 is a side view of an apparatus for the practice of the present invention that is best adapted for fires in low-pressure oil wells, and FIG. 1A is a top view of the containment cap 20 of FIG. 1. In FIGS. 1 and 1A, a containment cap 20 of steel or a similar material is placed over a fire in an oil well, leaking pipe line, or the like. The fire is not shown here. The containment cap 20 resembles a hat. A manifold 22 is connected to nozzles inside the containment cap 20 to fill the space inside the containment cap 20 with carbon dioxide or a similar gas that will not support combustion and that will snuff out a fire. The containment cap 20 is connected by a boom 24 to a control loader 26, preferably an articulated vehicle that can move the containment cap 20 to a burning oil well and place the containment cap 20 over the fire. The control loader 26 also includes one or more carbon dioxide tanks 28 that supply carbon dioxide through a pipe 30 in the boom 24 to the manifold 22. The pipe 30 has conventional flexible connections to the manifold 22 and at the control loader 26. The tanks 28 could equally as well be carried in a separate vehicle or standing apart from the control loader 26. A hydraulic cylinder 32 makes it possible to raise and lower the boom 24 from the control loader 26, and a hydraulic cylinder 34 makes it possible to change the orientation of the containment cap 20 with respect to the ground. The boom 24 provides the protection of distance for the driver of the control loader 26 as the control loader 26 approaches a fire and additional protection is supplied by a heat shield 36. Carbon dioxide from the tank 28 may be supplied to the containment cap 20 under its own pressure or it may be pumped by a pump 40 under power from an engine 38 in the control loader.

Figure 2:
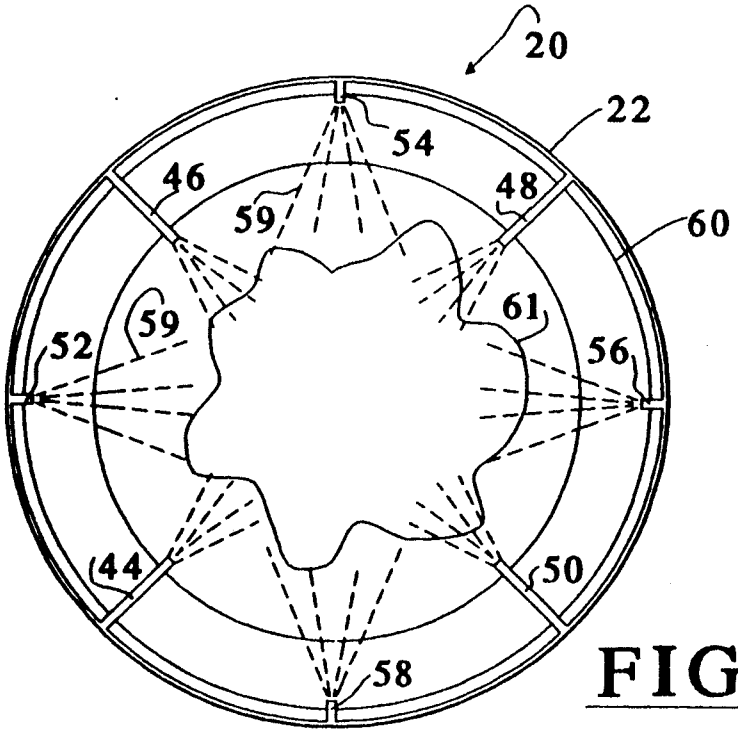
FIG. 2 is a sectional top view of the containment cap 20 of FIG. 1 taken along section lines 2—2 of FIG. 1.

FIG. 2 is a sectional top view of the containment cap 20 of FIG. 1, taken along section lines 2—2 of FIG. 1. In FIG. 2, the manifold 22 is connected to a plurality of high nozzles 44, 46, 48, and 50 which spray carbon dioxide or a similar fluid that is appropriate for fighting fires into the inside of the containment cap 20. A plurality of low nozzles 52, 54, 56, and 58 direct the carbon dioxide or other fluid in a spray 54 nearer to the base of the containment cap 20. The containment cap 20 thus defines a volume within which a fire 61 can be contained and quenched by the application of carbon dioxide. The containment cap 20 is preferable for use on fires in which the flow of oil from a burning oil well or of fuel or petrochemicals from a burning pipeline is at a low enough rate that the containment cap 20 is not pushed aside, damaged, or distorted by the flow of the combustible fluid.

Figure 3:
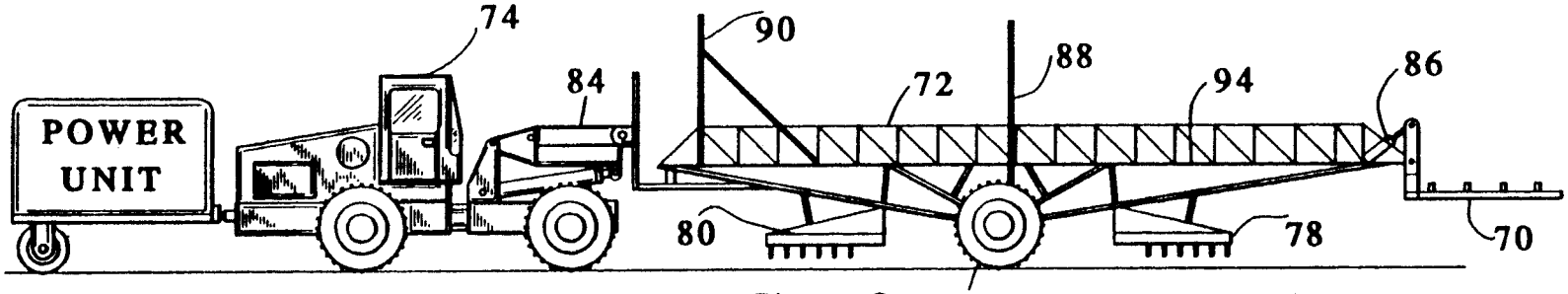
FIG. 3 is a side view of an alternate embodiment of an apparatus for the practice of the invention that is especially appropriate for fires in high-pressure oil wells.
Figure 4:
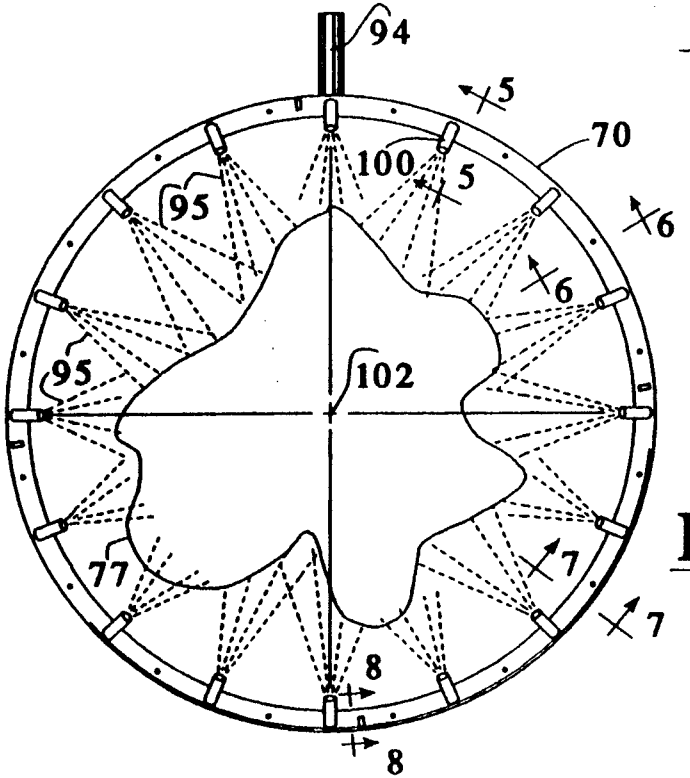
FIG. 4 is a top view of the fire-extinguishing ring shown in FIG. 3.

FIG. 3 is a side view of an alternate embodiment of an apparatus for the practice of the present invention to fight fires in which the burning fluid is escaping at a combination of pressure and volume that would push aside the containment cap 20 of FIG. 1, and FIG. 4 is a top view of a portion of the apparatus of FIG. 3. In FIGS. 3 and 4, a ring 70 is connected to a boom 72 which in turn is connected to a control loader 74. The boom 72 is shown here as a walking boom, which means that it is supported by a pair of wheels 76 rather than being cantilevered as was the boom 24 of FIG. 1. This is a matter of design choice. The walking boom 72 of FIG. 3 can be made longer to provide more distance between the control loader 74 and the ring 70. The walking boom 72 is also of particular utility in putting out fire 77 in oil wells where the surroundings may be mined. In addition to the greater distance from a fire 77 provided to an operator of the control loader 74, it is possible to hang rake harrows 78 and 80 to detonate any land mines that may have been placed around a burning oil well. The control loader 74 has a hydraulically-operated arm 84 that can be raised and lowered to place the ring 70 at a desired level. A hydraulic cylinder 86 allows the ring 70 to be placed at a desired angle with respect to the boom 72 for effective operation. Heat shields 88 and 90 provide protection for an operator of the control loader 74 against heat from a fire in a burning oil well as the ring 70 is moved to enclose the flames. When it is, power unit 92 pumps carbon dioxide or another appropriately chosen substance through a pipe 94 to the ring 70. At the ring 70 the carbon dioxide is pumped in a spray 95 through a plurality of nozzles that are indicated in FIGS. 5-7.

Figure 5:
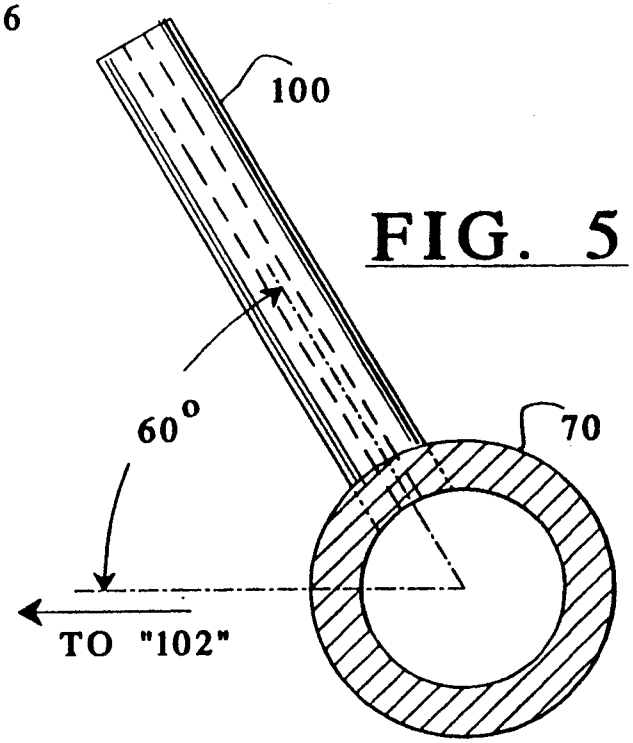
FIG. 5 is a sectional side view of a lower exterior spray nozzle taken along section lines 5—5 of FIG. 4.

FIG. 5 is a sectional view taken along section lines 5—5 of FIG. 4 to show a high spray nozzle 100. The high spray nozzle 100 is directed at an angle of about 60' to the horizontal and is inclined toward the center 102 of a circle that defines the ring 70. The high spray nozzle 100 is not shaped to disperse the fluid it sprays, so it will shoot a fairly straight stream. A plurality of the high spray nozzles 100 together forms a substantially cylindrical curtain of carbon dioxide that prevents oxygen from reaching the fire, causing it to stop burning.

Figure 6:
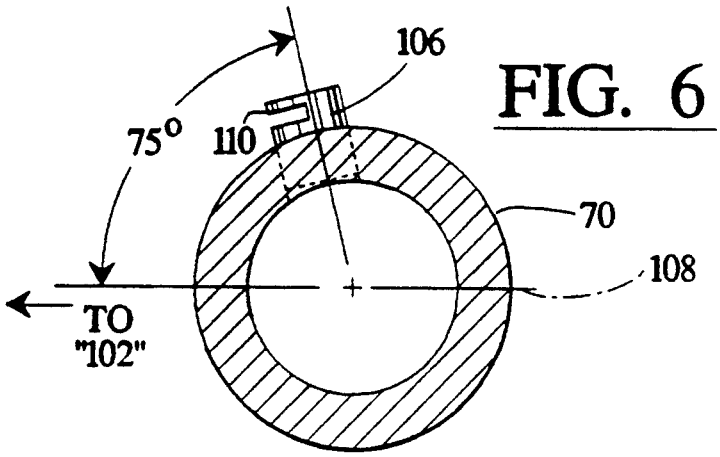
FIG. 6 is a sectional side view of a vertical fan spray nozzle taken along section lines 6—6 of FIG. 4.

FIG. 6 is a sectional view of a lower interior fan spray nozzle, taken along section lines 6—6 of FIG. 4. In FIG. 6, the ring 70 is coupled to a lower interior fan spray nozzle 106 that is set at an angle of about 75° to the plane 108 of the ring 70, and is inclined toward the center 102 of the circle formed by the ring 70. Cutout 110 in the nozzle 106 directs a fan spray of carbon dioxide over an angle of about 180° that is directed toward the base of a fire. In addition to preventing oxygen at and near the ground from reaching the fire that is centered at the center 102, the nozzle 106 helps to cool the ground and any remaining components from the oil well or pipe line, so that the fire will not be reignited when the flow of carbon dioxide is stopped.

Figure 7:
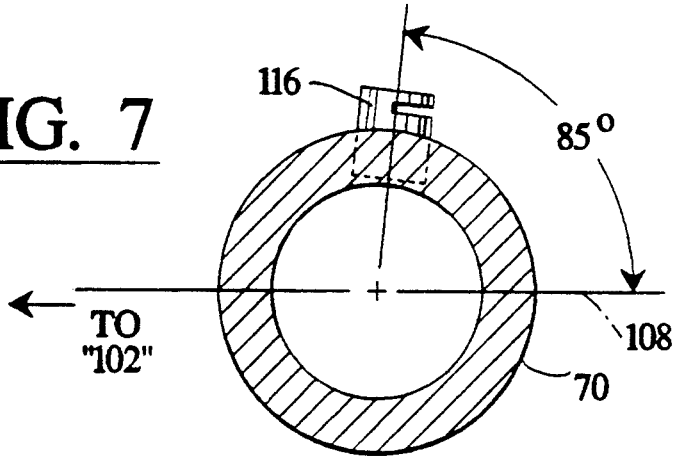
FIG. 7 is a sectional side view of a spray nozzle taken along section lines 7—7 of FIG. 4.

FIG. 7 is a sectional view of a lower exterior fan spray nozzle 116 of FIG. 4, taken along section lines 7—7 of FIG. 4. In FIG. 7, the nozzle 116 is inclined at an angle of about 85° to the plane 108 of the ring 70, and it is directed away from the center 102 of the circle formed by the ring 70. The cut-out 118 directs carbon dioxide in a fan pattern over about 180°. The nozzle 116 thus directs the flow of carbon dioxide or other appropriate fire fighting fluid toward the ground along the outside of the ring 70 to cool the ground and any hot components outside the ring 20 as well as to provide a barrier against entry of oxygen into the ring 70 to support combustion.

Figure 8:
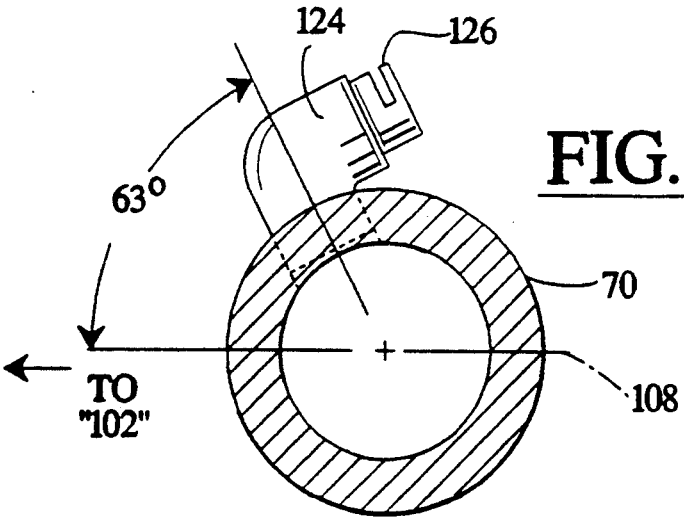
FIG. 8 is a sectional side view of a nozzle taken along section lines 8—8 of FIG. 4.

FIG. 8 is a sectional view of a shielding nozzle 124 taken along section lines 8—8 of FIG. 4. In FIG. 8, the nozzle 124 is set to provide a fan spray covering about 180° in a plane that is at an angle of about 63° to the plane 108 of the ring 70. A cutout 126 provides the fan-spray pattern, which is directed as shown toward the center 102 of the circle formed by the ring 70. The nozzle 124 provides a backing wall to the spray provided by the high spray nozzles 100 of FIG. 5.

In an apparatus that was built and tested for the practice of the present invention, sixteen high-spray nozzles 100 were spaced equally around a ring 70, which was an extra-strength drawn steel tubing having an internal diameter of two inches and an outside diameter of three inches. Eight lower interior fan spray nozzles 106 were spaced equally about the ring 70, as were eight exterior fan spray nozzles 116. Four vertical fan spray nozzles 124 were also spaced equally about the ring 70. Liquid carbon dioxide was pumped under a pressure of the order of 10,000 pounds per square inch to direct the flow of carbon dioxide along a surface that was substantially conical about an axis through the fire. The ring 70 of FIG. 4 with the nozzles just described was effective in putting out high-pressure fires in fuel oil and diesel fuel in simulated tests.

A device embodying the containment cap 20 of FIG. 1 was also effective in putting out simulated fires in fuel oil and diesel fuel that was pumped under pressures that were not sufficient to dislodge the containment cap 20 from its position over the fire. The boom 24 was placed by moving a loader 26 so as to be able to place the cap 20 over a fire which was extinguished by the flow of liquid carbon dioxide that was pumped at a pressure of about 1000 pounds per square inch. Pressures such as this can be contained in ordinary steel pipe, while the higher pressures typically used with the ring 70 of FIG. 3, of the order of 10,000 pounds per square inch, require the use of a pierced seamless pipe of an alloy steel or the like that will contain the pressure.

This description of the invention is intended to enable the practice of the invention and should not be taken as a limit on the invention, which is limited only by the scope of the appended claims and their equivalents.

What is claimed is:

1. An apparatus for extinguishing a fire in an oil well comprising:

a. a pipe ring containing a plurality of spray nozzles;

b. a boom connected to the pipe ring;

c. a loader connected to the boom to control placement of the boom and hence of the pipe ring so as to surround the fire; and d. means for pumping liquid carbon dioxide through the spray nozzles in a pattern that excludes air from the fire.

2. The apparatus of claim 1 wherein the means for pumping comprises:

a. a pump disposed at the loader; and b. a pipe connected to the pump and to the pipe ring along the boom, the pipe conducting the liquid carbon dioxide to the pipe ring to be sprayed through the nozzles at the fire.

3. The apparatus of claim 2 wherein the nozzles are disposed in a pattern that sprays liquid carbon dioxide in a substantially cylindrical curtain about the fire.

4. An apparatus for extinguishing a fire in an oil well comprising:

a ring forming a manifold;

a plurality of nozzles connected to the ring to direct a spray inside the ring in a predetermined pattern;

a boom connected to the ring;

a pipe connected flexibly to the manifold, the pipe disposed along the boom;

a loader connected to the boom;

a tank of liquid carbon dioxide disposed at the loader; and a pump connected to the tank and the pipe to supply the carbon dioxide under pressure to the pipe and hence to the manifold and the nozzles, whereby the nozzles direct the spray of liquid the carbon dioxide on the fire.

* * * * *